US010891841B2

(12) United States Patent
Favors

(10) Patent No.: US 10,891,841 B2
(45) Date of Patent: Jan. 12, 2021

(54) APPARATUS AND SYSTEM FOR CAPTURING CRIMINALS

(71) Applicant: Alexander Favors, Albrightsville, PA (US)

(72) Inventor: Alexander Favors, Albrightsville, PA (US)

( * ) Notice: Subject to any disclaimer, the term of this patent is extended or adjusted under 35 U.S.C. 154(b) by 59 days.

(21) Appl. No.: 16/291,045

(22) Filed: Mar. 4, 2019

(65) Prior Publication Data

US 2020/0286349 A1 Sep. 10, 2020

(51) Int. Cl.
*G08B 15/00* (2006.01)
*E04B 1/92* (2006.01)

(52) U.S. Cl.
CPC ..... *G08B 15/007* (2013.01); *E04B 1/92* (2013.01)

(58) Field of Classification Search
CPC ..... G08B 15/007; G08B 15/00; E04B 1/92; B25J 9/0003; B25J 9/00; B25J 9/0018; B25J 11/00; B25J 11/002; B25J 13/006; B25J 15/00; B25J 15/0028; B25J 15/0206; B25J 15/08; B25J 19/00; B25J 19/02; B25J 19/021; B25J 19/022; B25J 19/023; B25J 19/026
See application file for complete search history.

(56) References Cited

U.S. PATENT DOCUMENTS

| | | | | |
|---|---|---|---|---|
| 4,839,980 | A * | 6/1989 | Hersom | A01K 77/00 43/11 |
| 9,050,723 | B1 * | 6/2015 | Elazary | G06F 11/0793 |
| 9,387,895 | B1 * | 7/2016 | Theobald | B25J 5/005 |
| 2003/0208189 | A1 * | 11/2003 | Payman | A61F 9/008 606/5 |
| 2005/0166441 | A1 * | 8/2005 | Mattox | F41H 13/0006 43/1 |
| 2007/0192910 | A1 * | 8/2007 | Vu | G05D 1/0274 700/245 |
| 2015/0242812 | A1 * | 8/2015 | Nelson | G06Q 50/22 705/311 |
| 2016/0059412 | A1 * | 3/2016 | Oleynik | B25J 13/02 700/257 |
| 2017/0028557 | A1 * | 2/2017 | Battisti | B25J 9/1684 |
| 2017/0348854 | A1 * | 12/2017 | Oleynik | A47J 47/02 |
| 2019/0047068 | A1 * | 2/2019 | Magnasco | B23K 31/125 |
| 2019/0168391 | A1 * | 6/2019 | Ohm | B25J 19/023 |
| 2019/0176348 | A1 * | 6/2019 | Bingham | B25J 9/1035 |
| 2020/0055195 | A1 * | 2/2020 | Ignakov | B25J 13/006 |
| 2020/0086493 | A1 * | 3/2020 | Caron L'Ecuyer | H04N 5/2258 |

FOREIGN PATENT DOCUMENTS

| | | | | |
|---|---|---|---|---|
| CA | 2812875 | A1 * | 10/2014 | E05G 5/02 |
| WO | WO-2005008009 | A1 * | 1/2005 | G08B 15/007 |

* cited by examiner

*Primary Examiner* — Christopher R Harmon

(57) ABSTRACT

Disclosed is an overhead criminal capturing system comprised of joysticks, buttons, video display, microphone, speaker and a virtual reality headset remotely controlling an electrically motorized mechanical gripper that is attached to an electrically motorized mechanical arm that is attached to an electrically motorized wall and ceiling mounted rail system.

3 Claims, 8 Drawing Sheets

APPARATUS AND SYSTEM FOR CAPTURING CRIMINALS

BACKGROUND OF THE INVENTION

People commit crimes because they believe no one will hastily intervene in their heinous acts. History shows security personnel will cautiously pursue and capture the criminal. But being cautious lengthens the time to end the heinous act. The present disclosed invention will shorten or prevent the heinous act by having remote joysticks, remote buttons, remote video display, and a remote virtual reality headset control an electrically motorized wall and ceiling mounted rail gripper to hastily pursue, intervene, and capture the criminal by maneuvering overhead of non-criminals to attack the criminal from above by ejecting an entrapping net and gripping onto the criminal.

BRIEF SUMMARY OF THE INVENTION

The invention as claimed is a remote-controlled mechanical gripper constructed to capture a person from overhead by ejecting an entrapping net and gripping onto the criminal. The invention as claimed contains a wall and ceiling mounted rail system, rail carriage, mechanical articulated arm, mechanical articulated gripper, site controller housing, and remote controller housing. Said gripper supports electric motors, tether, entrapping net, deployment chute, compressed gas cartridge, mechanical fingers, laser, microphone, LED, infrared emitter, cameras, switch, speaker, and electrical shock causing spikes. Said arm supports electric motors, camera, and electrical shock causing surfaces. Said carriage supports power and data collectors, electric motors, and wheels. Said rail system supports electric motors, power and data rails, microphones, power-data transfer box, multi-conductor cable, wall mounts, and ceiling mounts. Said site controller supports batteries, power supply, power cord, communication processors, and electric motor control processors. Said remote controller supports batteries, power supply, power cord, communication processors, virtual reality headset, joysticks, buttons, video display, microphone, and speaker.

DETAILED DESCRIPTION OF THE INVENTION

An apparatus and system for capturing criminals according to an embodiment of the present invention will now be described with reference to the drawings.

Figure 1:
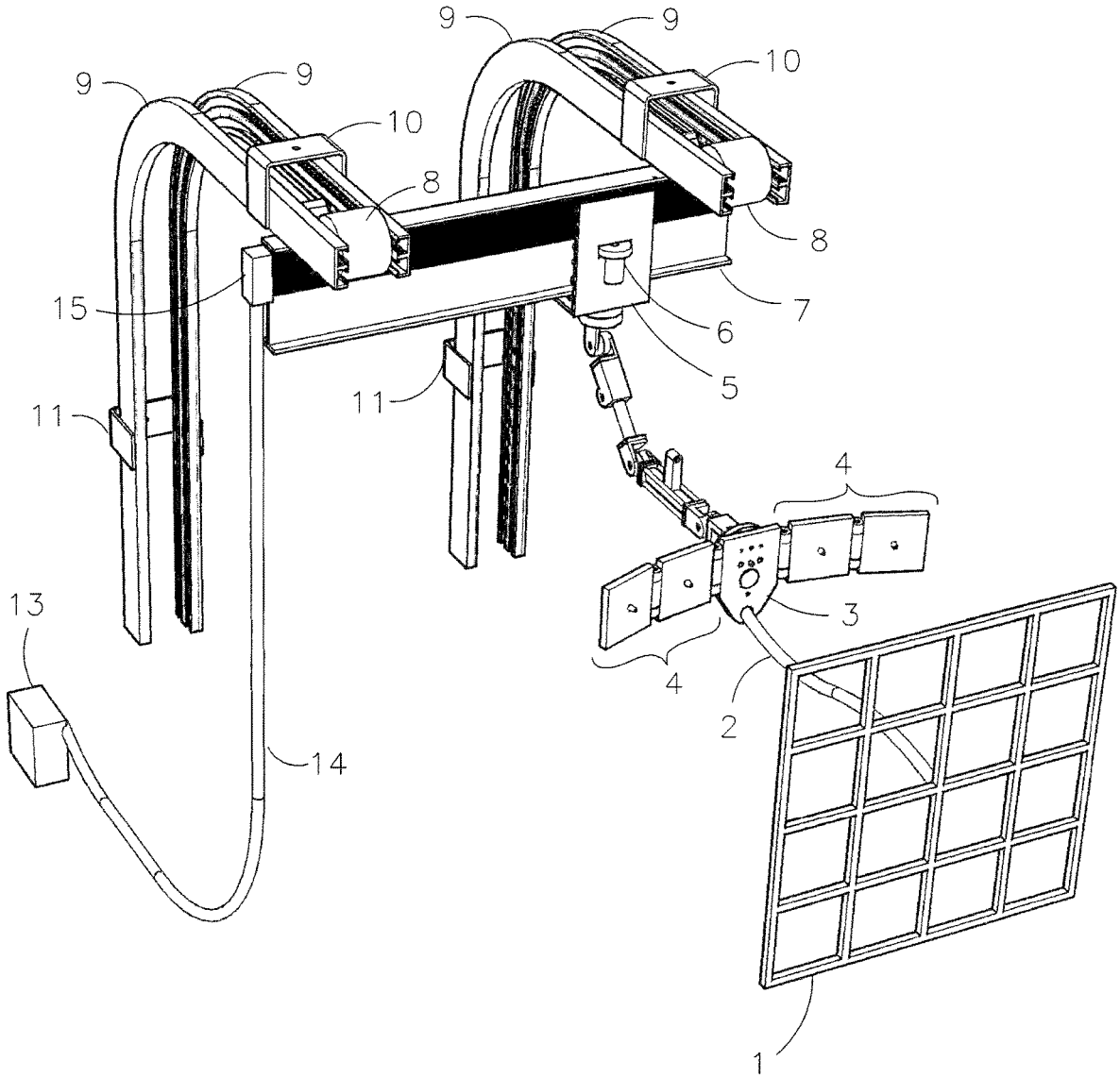
FIG. 1 illustrates the remotely controlled parts of the criminal capturing system.

As shown in FIG. 1, the present invention is constituted of a Just For Nets entrapping net 1, part number FBAGONN18SIB10X10, Tough-Grid Paracord tether 2, part number PC50-CG-7501b-MS, custom made aluminum gripper palm 3, custom made aluminum mechanical finger 4, custom made aluminum carriage 5, custom made brushless DC electric carriage drive forward-backward traversing motor 6, custom length aluminum standard I-Beam forward-backward traversing rail 7, custom made DC electric left-right-up-down traversing geared motor 8, custom made steel left-right-up-down traversing rail 9, custom made steel ceiling mount 10, custom made steel wall mount 11, custom made site controller housing 13, Show Me Cables site controller multi-conductor cable 14, part number 82-600-430, and custom made steel power-data transfer box 15. Said left-right-up-down traversing geared motor 8 has circular gears that meshes with a linear gear track that is built into said left-right-up-down traversing rail 9.

Figure 2:
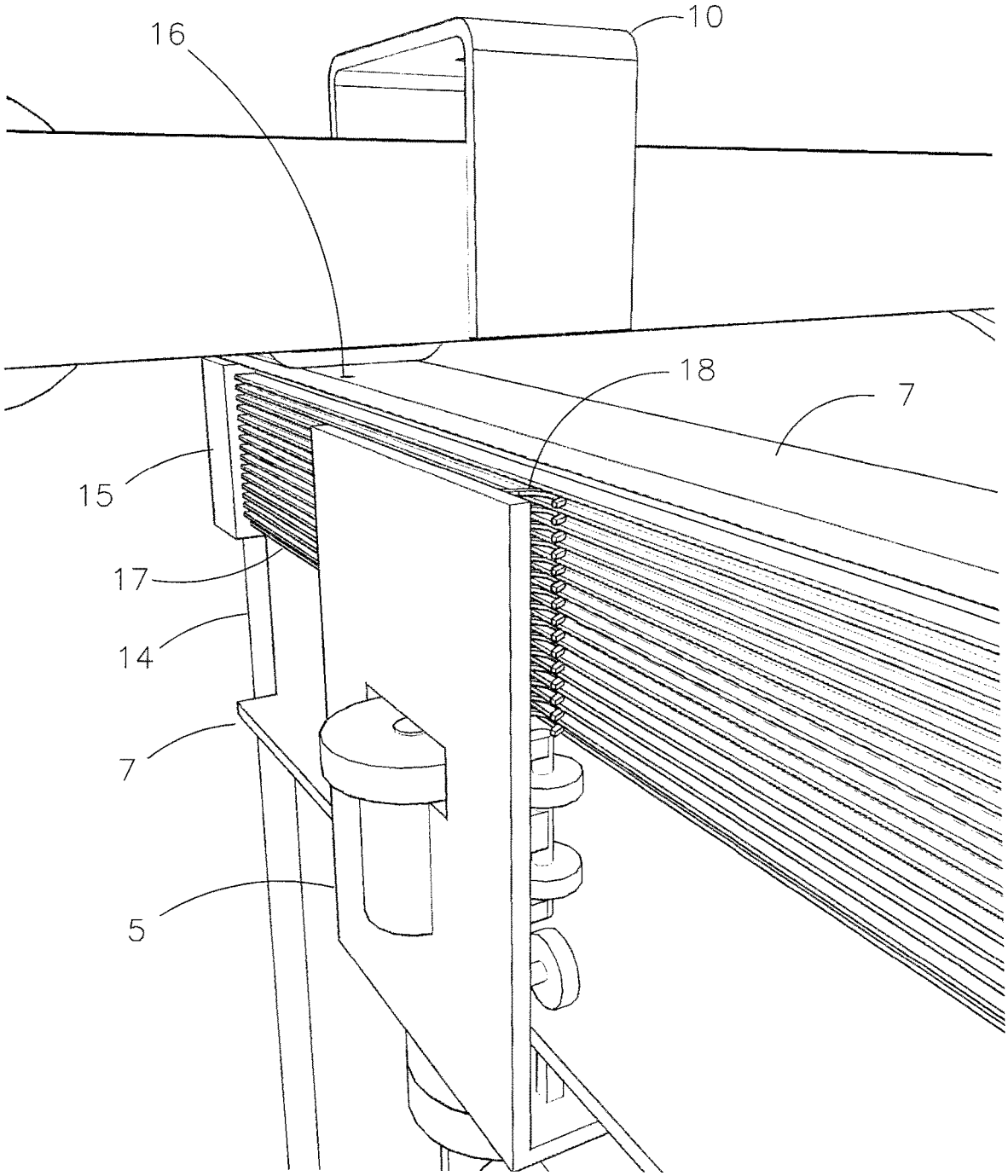
FIG. 2 illustrates a partial enlarged view of the remotely controlled parts of the criminal capturing system to show more details of the arm and rails components.

As shown in FIG. 2, the present invention is constituted of said carriage 5, said forward-backward traversing rail 7, said ceiling mount 10, said cable 14, said power-data transfer box 15, CUI Inc rail microphone 16, part number CMC-6022-37T, custom made power and data metal rails 17, and custom made power and data metal collectors 18.

Figure 3:
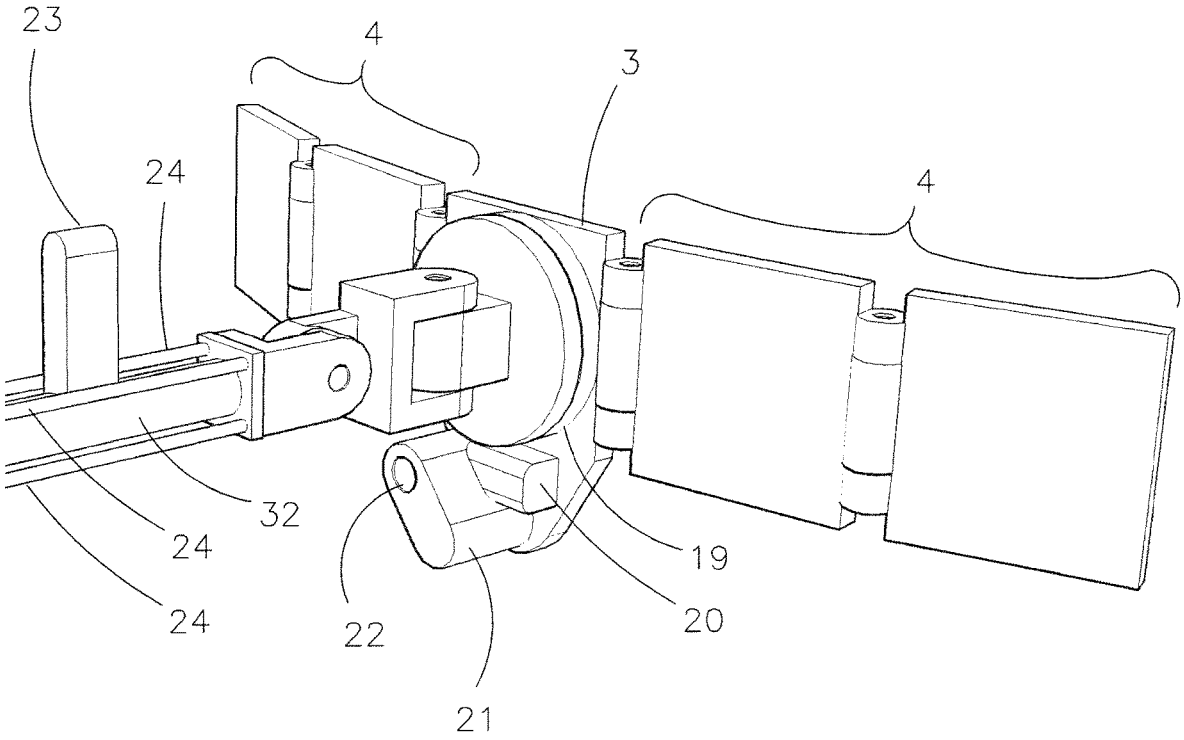
FIG. 3 illustrates a partial enlarged view of the remotely controlled parts of the criminal capturing system to show more details of the arm and gripper components.

As shown in FIG. 3, the present invention is constituted of said gripper palm 3, said mechanical finger 4, custom made gripper roll DC electric stepper motor 19, custom made DC electric stepper puncture motor 20, custom made ejection chute 21, Crosman compressed gas cartridge 22, part number 2311, Adafruit arm camera 23, part number 3100, custom made electrified metal rods 24, and custom made aluminum arm shaft 32. Said rods 24 are to protect said arm shaft 32 from vandalism. Said puncture motor 20 will puncture said gas cartridge 22 to release gas into said chute 21 to eject said net 1 and tether 2 out of said chute 21.

Figure 4:
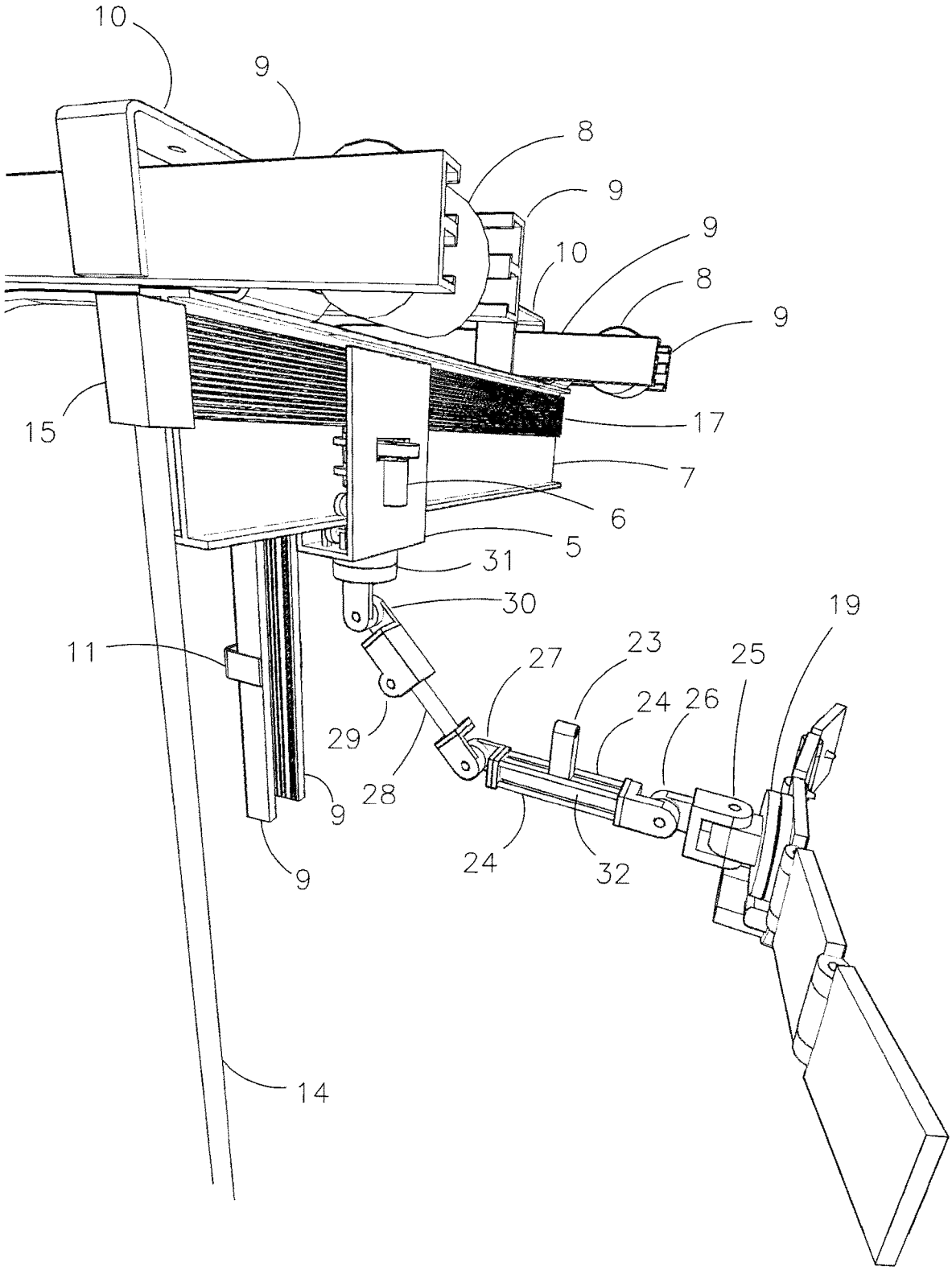
FIG. 4 illustrates a partial enlarged view of the remotely controlled parts of the criminal capturing system to show more details of the rails, arm, and gripper components.
Figure 5:
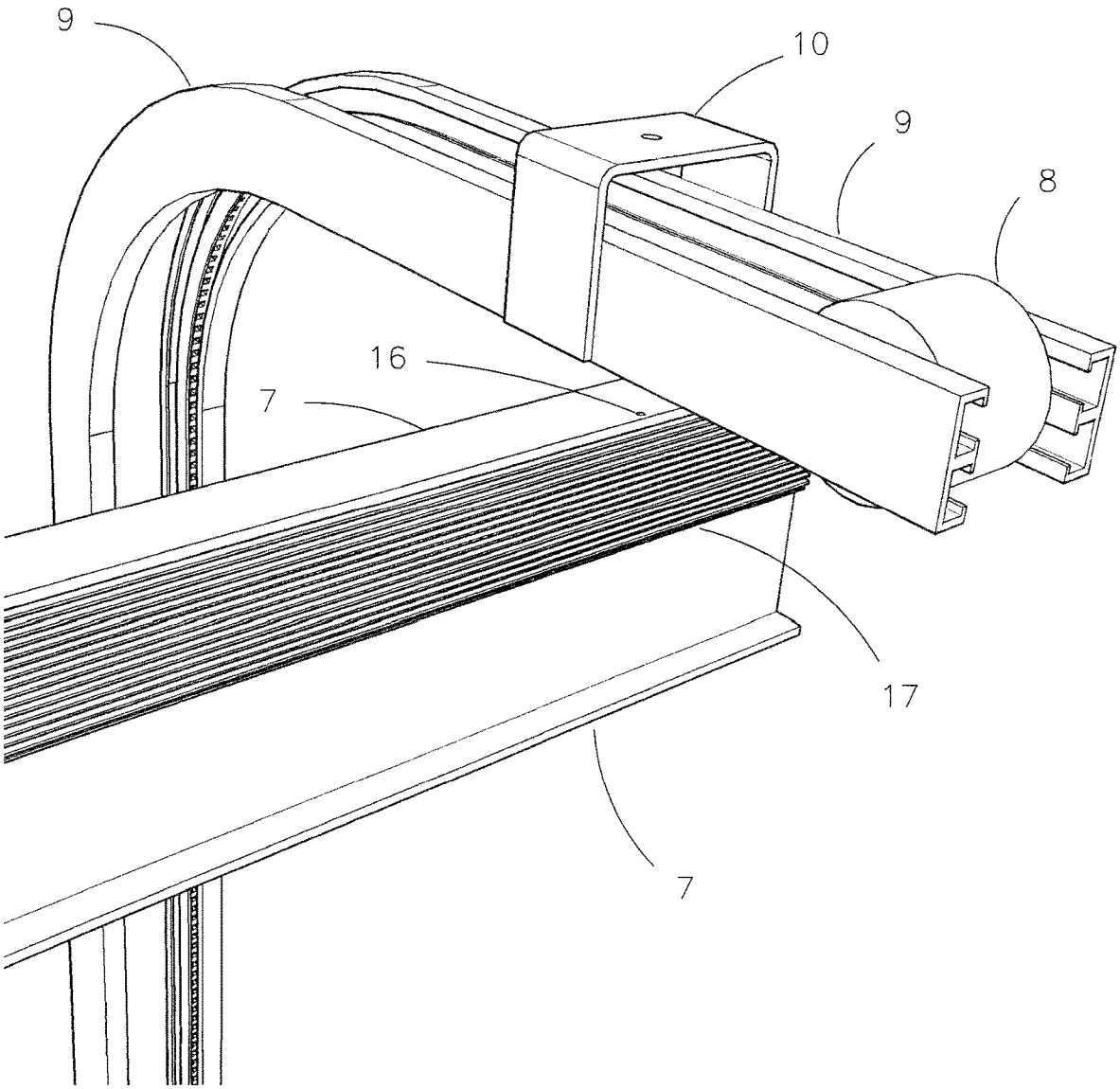
FIG. 5 illustrates a partial enlarged view of the remotely controlled parts of the criminal capturing system to show more details of the rails components.

As shown in FIG. 4, the present invention is constituted of said carriage 5, said traversing motor 6, said traversing rail 7, said geared motor 8, said traversing rail 9, said ceiling mount 10, said wall mount 11, said cable 14, said transfer box 15, said power and data metal rails 17, said motor 19, said camera 23, said rods 24, said arm shaft 32, custom made gripper yaw DC electric stepper motor 25, custom made gripper pitch DC electric stepper motor 26, custom made arm joint DC electric stepper motor 27, custom made arm telescoping shaft 28, custom made arm telescoping DC electric stepper motor 29, custom made arm pitch DC electric stepper motor 30, and custom made arm pivot DC electric stepper motor 31. As shown in FIG. 5, the present invention is constituted of said traversing rail 7, said geared motor 8, said traversing rail 9, said ceiling mount 10, said rail microphone 16, and said power and data metal rails 17.

Figure 6:
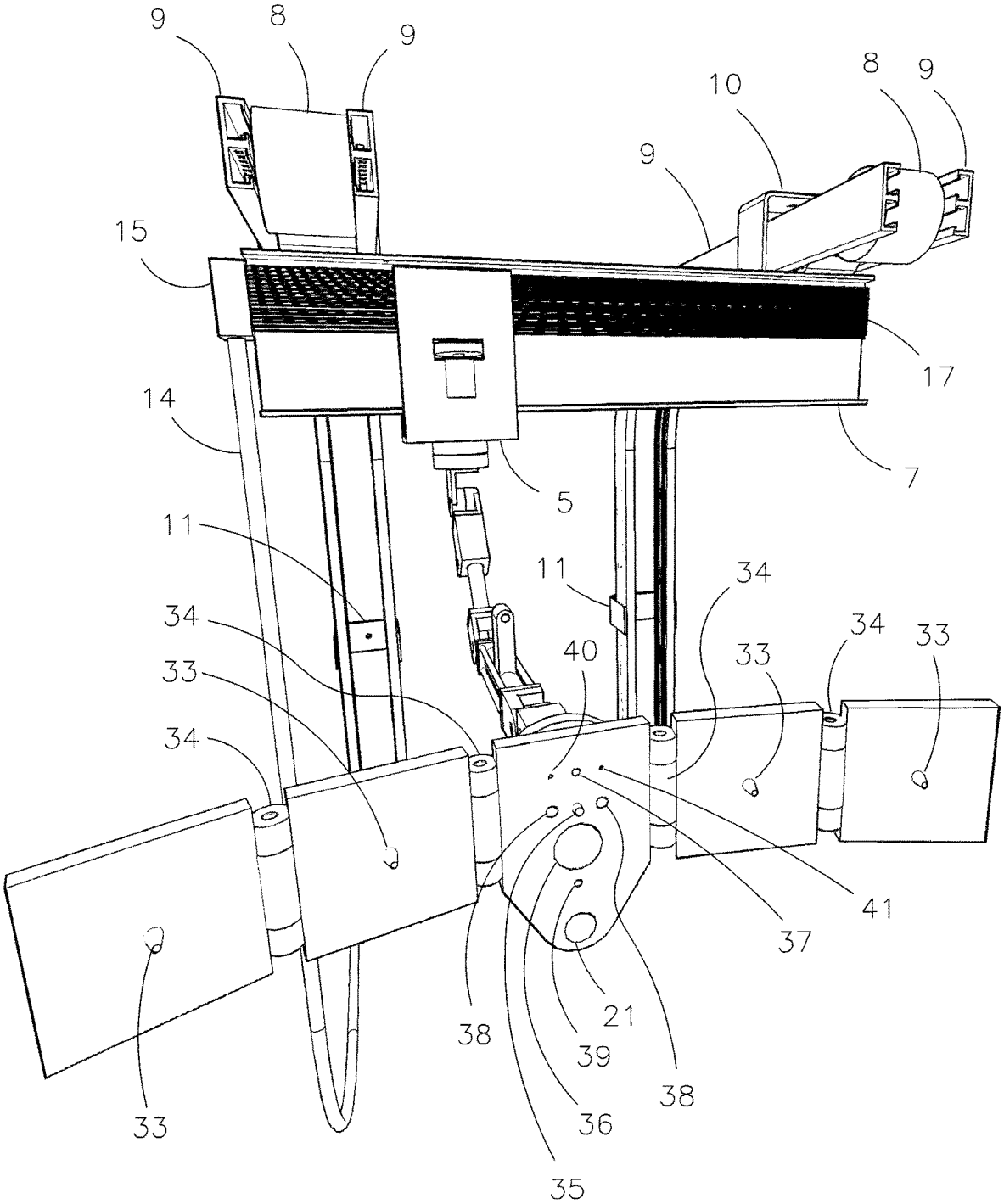
FIG. 6 illustrates a partial enlarged view of the remotely controlled parts of the criminal capturing system to show more details of the rails, arm, and gripper components.

As shown in FIG. 6, the present invention is constituted of said carriage 5, said traversing rail 7, said geared motor 8, said traversing rail 9, said ceiling mount 10, said wall mount 11, said cable 14, said transfer box 15, said power and data metal rails 17, said chute 21, custom made gripper finger joint DC electric stepper motor 34, custom made electrified metal spike 33, Urtone gripper palm contact switch 35, part number UR125, Pyle gripper palm speaker 36, part number PWRC55BT, CUI Inc gripper palm microphone 37, part number CMC-6022-37T, Adafruit gripper palm camera 38, part number 3100, Dtol gripper palm laser 39, part number BOOR73MCIS, Forge gripper palm LED 40, part number FEL-F115W15V12, and Vishay gripper palm infrared emitter 41, part number TSAL6100. Said laser 39, said arm camera 23, and said palm camera 38 is to aid in guiding the gripper assembly to the criminal to either deploy said entrapping net 1 onto the criminal or impact said contact switch 35 into the criminal. Depressing said contact switch 35 will cause said mechanical finger 4 to close towards said gripper palm 3.

Figure 7:
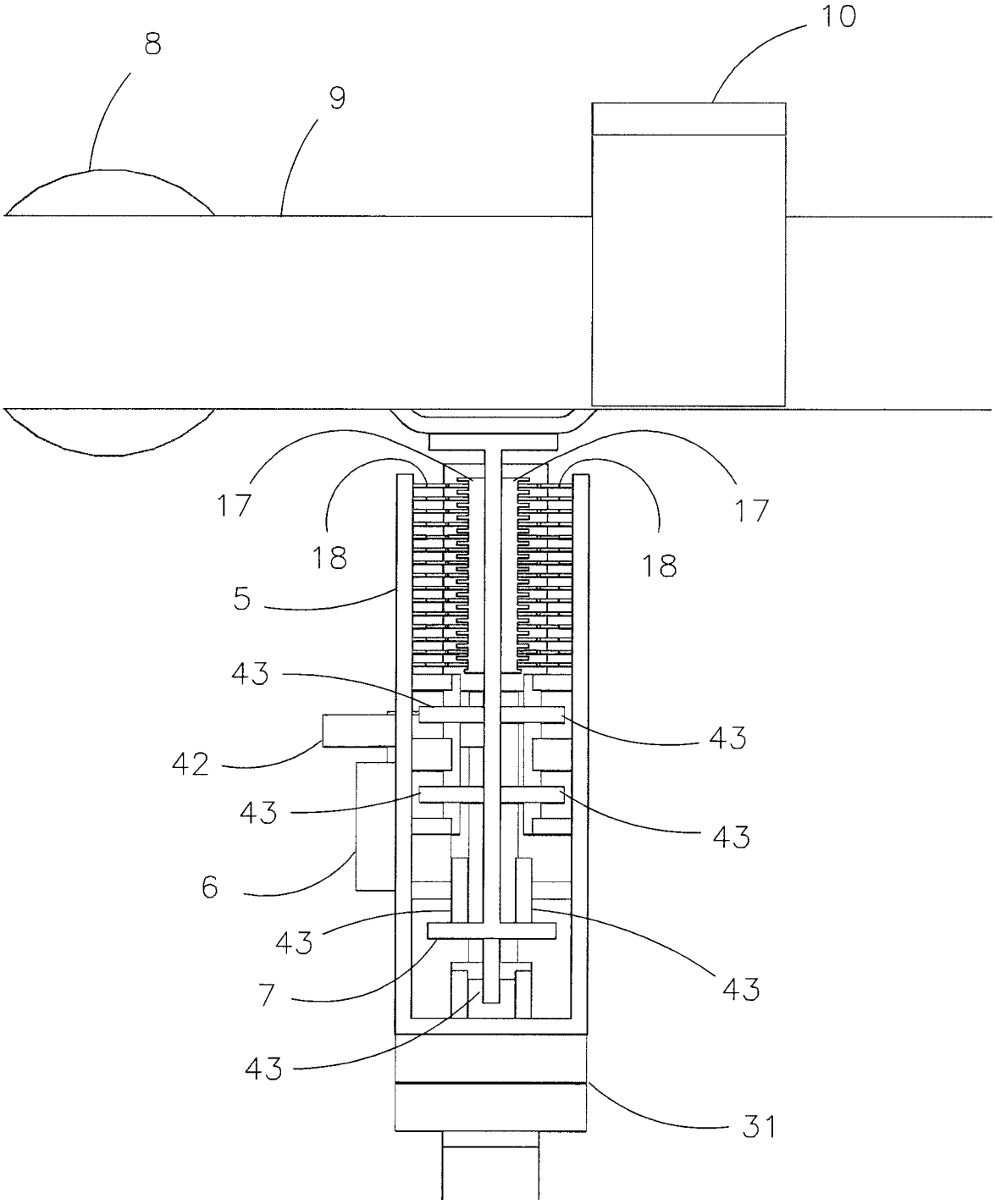
FIG. 7 illustrates a partial enlarged view of the remotely controlled parts of the criminal capturing system to show more details of the arm and rails components.

As shown in FIG. 7, the present invention is constituted of said carriage 5, said carriage drive forward-backward traversing motor 6, said traversing rail 7, said left-right-up-down traversing geared motor 8, left-right-up-down traversing rail 9, said ceiling mount 10, said power and data metal rails 17, said power and data metal collectors 18, said motor 31, Durable Superior Casters carriage friction drive wheel 42, part number RA80HB95, and Rollerex carriage roller wheel 43, part number VXT500.

Figure 8:
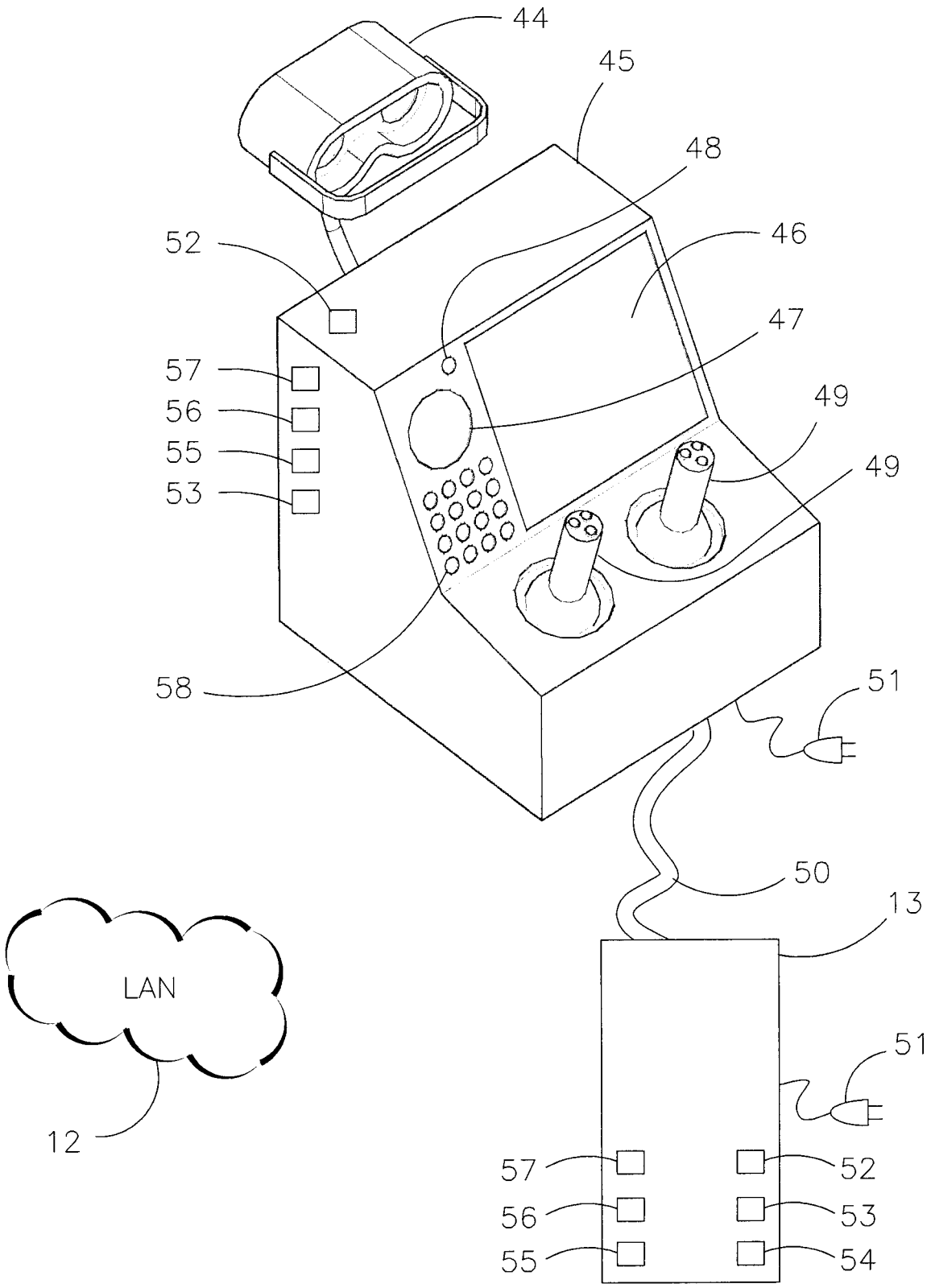
FIG. 8 illustrates the remote controller components and site controller components of the criminal capturing system.

As shown in FIG. 8, the present invention is constituted of said site controller housing 13, custom made remote controller housing 45, VisionHMD remote controller virtual reality headset 44, part number BIGEYESAI, Pyle remote controller display 46, part number PHR105B, Pyle remote controller speaker 47, part number PWRC55BT, CUI Inc remote controller microphone 48, part number CMC-6022-37T, Adafruit remote controller joystick 49, part number 3464, Show Me Cables remote controller multi-conductor cable 50, part number 82-600-430, Palm Network Solutions power cord 51, part number B07G2NJX1R, Uxcell remote controller button 58, part number A14101000UX0766, MightyMax battery 52, part number ML 12-12, Altronix power supply 53, part number OLS120D2, Adafruit site controller motor controller processor board 54, part number 2348, Adafruit operating system software 55, part number 1583, Adafruit CPU 56, part number 3775, and Adafruit I/O PCB 57, part number 3289. Said rail microphone 16 is for detecting stronger than normal area acoustic levels to alert said remote controller 45. Said arm camera 23 sends its captured images to said remote controller display 46. Said gripper palm camera 38 sends its captured images to said remote controller virtual reality headset 44. Said CPU 56 has the capability to connect to a LAN 12. Said gripper palm microphone 37 transmits its signals to said remote controller speaker 47. Said remote controller microphone 48 transmits its signals to said gripper palm speaker 36.

The invention claimed is:

1. A gripper assembly for capturing criminals from overhead comprising: gripper palm; laser, attached to said gripper palm; remote button, to activate said laser; ejection chute, constructed onto said gripper palm; tether, attached to inside of said ejection chute and said tether stored in said ejection chute; entrapping net, attached to said tether and said entrapping net stored in said ejection chute; compressed gas cartridge, attached to said gripper palm; electric motor, attached to said gripper palm; said electric motor to puncture said compressed gas cartridge to release compressed gas cartridge contents into said election chute to eject said entrapping net; remote button, to activate said electric motor; two cameras, attached to said gripper palm; remote button, to activate said cameras; speaker, attached to said gripper palm; remote button, to activate said speaker; LED, attached to said gripper palm; remote button, to activate said LED; infrared emitter, attached to said gripper palm; remote button, to activate said infrared emitter; microphone, attached to said gripper palm; remote button, to activate said microphone; two electrically motorized multiple jointed mechanical fingers, attached to said gripper palm; metal electrical shock causing surfaces, attached to said mechanical fingers; contact button, attached to said gripper palm; said contact button to activate said mechanical fingers; remote button, to activate said mechanical fingers; remote button, to activate said shock causing surfaces; an electrically motorized rotating triple axis mounting base, attached to said gripper palm; remote button, to activate said mounting base; remote joysticks, to control said mounting base; remote speaker, to relay the sound detected by said microphone; remote button, to activate said remote speaker; remote microphone, to transmit sound to said speaker; remote button, to activate said remote microphone; remote display panel, to display images from said cameras; remote button, to activate said remote display panel; remote virtual reality headset, to display images from said cameras; and remote button, to activate said virtual reality headset.

2. A gripper and articulated arm assembly for capturing criminals from Overhead comprising: gripper palm; laser, attached to said gripper palm; remote button, to activate said laser; election chute, constructed onto said gripper palm; tether, attached to inside of said ejection chute and said tether stored in said election chute; entrapping net, attached to said tether and said entrapping net stored in said ejection chute; compressed gas cartridge, attached to said gripper palm; electric motor, attached to said gripper palm; said electric motor to puncture said compressed gas cartridge to release compressed gas cartridge contents into said ejection chute to eject said entrapping net; remote button, to activate said electric motor; two cameras, attached to said gripper palm; remote button, to activate said cameras; speaker, attached to said gripper palm; remote button, to activate said speaker; LED, attached to said gripper palm; remote button, to activate said LED; infrared emitter, attached to said gripper palm; remote button, to activate said infrared emitter; microphone, attached to said gripper palm; remote button, to activate said microphone; two electrically motorized multiple jointed mechanical fingers, attached to said gripper palm; metal electrical shock causing surfaces, attached to said mechanical fingers; contact button, attached to said gripper palm; said contact button to activate said mechanical fingers; remote button, to activate said mechanical fingers; electrically motorized rotating triple axis mounting base, attached to said gripper palm; remote button, to activate said mounting base; remote joysticks, to control said mounting base; electrically motorized articulated telescoping mechanical arm, attached to said mounting base; remote button, to activate said mechanical arm; said remote joysticks, to control said mechanical arm; a camera, attached to said mechanical arm; remote button, to activate said camera on said mechanical arm; electrical shock causing surfaces, attached to said mechanical arm; remote button, to activate said shock causing surfaces; electrically motorized rotating dual axis wheeled mounting base carriage, attached to said mechanical arm; remote button, to activate said dual axis wheeled mounting base carriage; said remote joysticks, to control said dual axis wheeled mounting base carriage; power transfer sliding collectors, attached to said dual axis wheeled mounting base carriage; data transfer sliding collectors, attached to said dual axis wheeled mounting base carriage; remote speaker, to relay the sound detected by said microphone; remote button, to activate said remote speaker; remote microphone, to transmit sound to said speaker: remote button, to activate said remote microphone; remote display panel, to display images from said cameras; remote button, to activate said remote display panel; remote virtual reality headset, to display images from said cameras; and remote button, to activate said virtual reality headset.

3. A gripper, articulated arm, and rail assembly for capturing criminals from overhead comprising: gripper; laser, attached to said gripper palm; remote button, to activate said laser; ejection chute, constructed onto said gripper palm; tether, attached to inside of said ejection chute and said tether stored in said ejection chute; entrapping net, attached to said tether and said entrapping net stored in said election chute; compressed gas cartridge, attached to said gripper palm; electric motor, attached to said gripper palm: said electric motor to puncture said compressed gas cartridge to release compressed gas cartridge contents into said ejection chute to elect said entrapping net; remote button, to activate said electric motor; two cameras, attached to said gripper palm; remote button, to activate said cameras; speaker, attached to said gripper palm; remote button, to activate said speaker; LED, attached to said gripper palm; remote button, to activate said LED; infrared emitter, attached to said gripper palm; remote button, to activate said infrared emitter; microphone, attached to said gripper palm; remote button, to activate said microphone; two electrically motorized multiple jointed mechanical fingers, attached to said gripper palm; metal electrical shock causing surfaces, attached to said mechanical fingers; contact button, attached to said gripper palm; said contact button to activate said mechanical fingers; remote button, to activate said mechanical fingers; electrically motorized rotating triple axis mounting base, attached to said gripper palm; remote button, to activate said mounting base; remote joysticks, to control said mounting base; electrically motorized articulated telescoping mechanical arm, attached to said mounting base; remote button, to activate said mechanical arm; said remote joysticks, to control said mechanical arm; camera, attached to said mechanical arm; remote button, to activate said camera on said mechanical arm; electrical shock causing surfaces, attached to said mechanical arm: remote button, to activate said shock causing surfaces; electrically motorized rotating dual axis wheeled mounting base carriage, attached to said mechanical arm; remote button, to activate said dual axis wheeled mounting base carriage; said remote joysticks, to control said dual axis wheeled mounting base carriage; power transfer sliding collectors, attached to said dual axis wheeled mounting base carriage; data transfer sliding collectors, attached to said dual axis wheeled mounting base carriage; electrically motorized forward-backward traversing rail, attached to said dual axis wheeled mounting base carriage; remote button, to activate said forward-backward traversing rail; said remote joysticks, to control said forward-backward traversing rail; left-right-up-down traversing rail, attached to said forward-backward traversing rail; wall mount, attached to said left-right-up-down traversing rail: ceiling mount, attached to said left-right-up-down traversing rail; microphone, attached to said forward-backward traversing rail; remote button, to activate said microphone attached to said forward-backward traversing rail; power transfer rails, attached to said forward-backward traversing rail; data transfer rails, attached to said forward-backward traversing rail; remote speaker, to relay the sound detected by said microphones; remote button, to activate said remote speaker; remote microphone, to transmit sound to said speaker: remote button, to activate said remote microphone; remote display panel, to display images from said cameras; remote button, to activate said remote display panel; remote virtual reality headset, to display images from said cameras; and remote button, to activate said virtual reality headset.

* * * * *